United States Patent [19]

Ostrowski et al.

[11] 4,073,129

[45] Feb. 14, 1978

[54] METHOD AND APPARATUS FOR MANUFACTURE OF YARN

[75] Inventors: Jerzy Ostrowski; Piotr Sierputowski, both of Warsaw; Lukasz Turkowski, Sule Jowek-Ratajewo; Jerzy Jablkiewicz; Jan Pacholski, both of Lodz; Tadeusz Jedryka, Warsaw, all of Poland

[73] Assignee: Centralny Osrodek Badawczo-Rozwojowy Maszyn Wlokienniczych, Lodz, Poland

[21] Appl. No.: 774,114

[22] Filed: Mar. 3, 1977

[30] Foreign Application Priority Data

Mar. 10, 1976 Poland ..... 187857

[51] Int. Cl.[2] ..... D01H 1/12

[52] U.S. Cl. ..... 57/58.89; 57/160

[58] Field of Search ..... 57/58.89–58.95, 57/34 R, 5, 156, 160

[56] References Cited

U.S. PATENT DOCUMENTS

| | | | |
|---|---|---|---|
| 3,577,720 | 5/1971 | Zax et al. | 57/58.89 |
| 3,851,455 | 12/1974 | Jozwicki et al. | 57/58.95 |
| 3,898,787 | 8/1975 | Wehling et al. | 57/58.89 |
| 3,994,120 | 11/1976 | Radom et al. | 57/58.89 |

FOREIGN PATENT DOCUMENTS

| | | | |
|---|---|---|---|
| 244,159 | 9/1969 | U.S.S.R. | 57/58.89 |
| 244,160 | 9/1969 | U.S.S.R. | 57/58.89 |

*Primary Examiner*—Donald Watkins
*Attorney, Agent, or Firm*—Haseltine, Lake & Waters

[57] ABSTRACT

In manufacturing yarn inside a cylindrical, non-rotational chamber, air jets cause rotational motion to the fibers introduced into the chamber. The whirl core vacuum suction zone, i.e. on the cylindrical insert lower face and/or in the chamber outlet, where the whirl core intensification takes place, the rotating velocity of the air stream whirled into the chamber interior becomes inhibited by reducing the rotating velocity within the whirl core. The chamber is provided with peripheral ducts to supply air and also a fiber delivering channel. A cylindrical insert has a lower face that has attached thereto, restricting blades 9 arranged in the chamber outlet from the vacuum source side.

2 Claims, 4 Drawing Figures

A-A

A-A

METHOD AND APPARATUS FOR MANUFACTURE OF YARN

BACKGROUND OF THE INVENTION

This invention is directed to a method and apparatus for pneumatic spinning of yarn from natural- and synthetic fibres.

The hitherto known method of pneumatic spinning consists of introducing fibres entrained by air into the non-rotational spinning chamber where they are acted upon by air jets and are caused to rotate in response thereto. As a result of peripheral velocities generated in the section where the yarn is being formed, it is twisted by gathering of the fibres from a whirling fiberous ring whereupon the produced yarn is discharged from the chamber.

Prior art equipment using the above-mentioned method consists of the cylindrical, non-rotatable chamber, which at one end communicates with a source of vacuum, and is closed at the other end. A cylindrical insert incorporating concentric channel discharges the ready yarn. From the vacuum side, this chamber is provided with peripheral tangent ducts to supply air, and a fibre delivery zone.

The spinning process rate according to the prior art is proportional to the peripheral velocities within the zone where the fibre ring is being formed, in the spinning section. The formation of the field of the peripheral velocities, however, is counter-acted by the whirl core being developed in the chamber centre line, whereby this whirl core stabilizes on the insert lower surface, and in the chamber outlet.

SUMMARY OF THE INVENTION

The principal feature of the present invention is directed to a method and apparatus for manufacturing yarn inside a cylindrical non-rotating chamber employing air jets for whirling fibres that have been introduced into the chamber. A zone with a vacuum suction of a whirl core of fibres is formed with an intensification zone so that the rotational velocity of the air flow in the chamber interior is inhibited and the velocity of the whirl core is reduced.

Also within the scope of the present invention is an apparatus in which a cylindrical insert is introduced in the spinning chamber with a lower face being provided with restricting blades and the camber outlet is provided with air guides.

The main object of the present invention is to overcome the defects of the prior art.

A further object of the present invention is to provide a method and apparatus for controlling velocity distribution in the section of a yarn forming chamber where the rotational velocity in the whirl core is reduced.

Other objects and advantages of the present invention will be more fully understood with respect to the specification, claims and accompanying drawings.

IN THE DRAWINGS

PREFERRED EMBODIMENT

The present invention is concerned with a method and apparatus in the zone where vacuum suction of the whirl core is encountered, i.e. on the cylindrical insert lower surface and/or in the chamber outlet, where it becomes intensified. The velocity of air whirled into the chamber interior is normally inhibited and there is a reduction in the rotational velocity in the whirl core.

The apparatus according to this invention, employs radial restricting blades having air guides arranged in the spinning chamber outlet from the vacuum source side.

With the method and apparatus according to this invention, appropriate velocity distribution becomes possible in the section of forming the yarn from the ring of rotating fibres, and thus the spinning rate can be increased accordingly.

Figure 1:
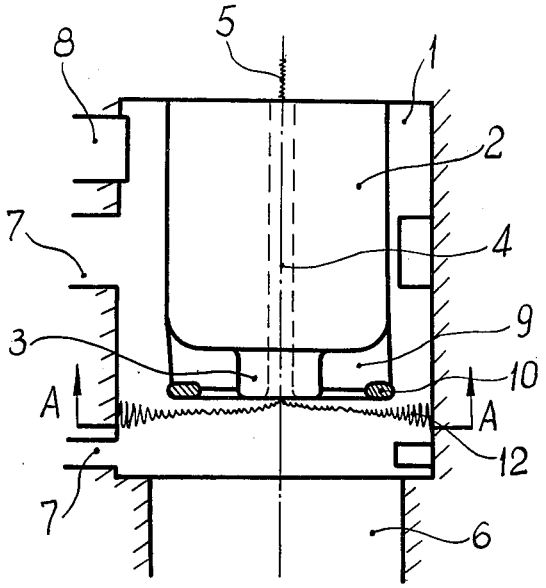
FIG. 1 illustrates a longitudinal sectional view of the invention.
Figure 2:
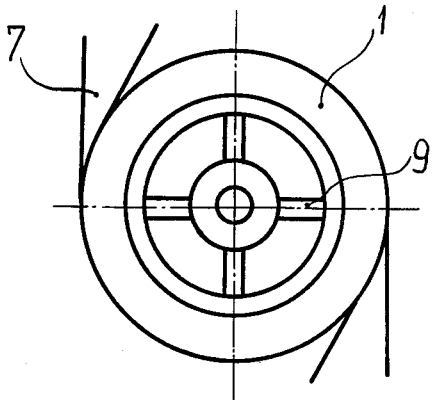
FIG. 2 is a view taken from the vacuum source side along lines A—A of FIG. 1.

According to FIG. 1, a cylindrical, non-rotational spinning chamber 1, is provided at one end with the cylindrical insert 2 having the cylindrical end boss 3. This insert 2 is provided with the concentric channel 4 for discharging the ready yarn 5. From its other end, the chamber 1 communicates via the suction duct 6 with the vacuum source (not shown). The chamber 1 has peripherhal ducts 7 to supply air thereinto, which can be arranged in any section of the chamber, and a fibre delivery channel 8, the latter being located in the upper part of the chamber. The lower face of the cylindrical insert 2 is provided with radial blades 9 to inhibit the velocity in the whirl core. A shield-ring 10 is attached to lower edges of restricting blades 9, to prevent the rotating fibres from being caught by the said blades.

Figure 3:
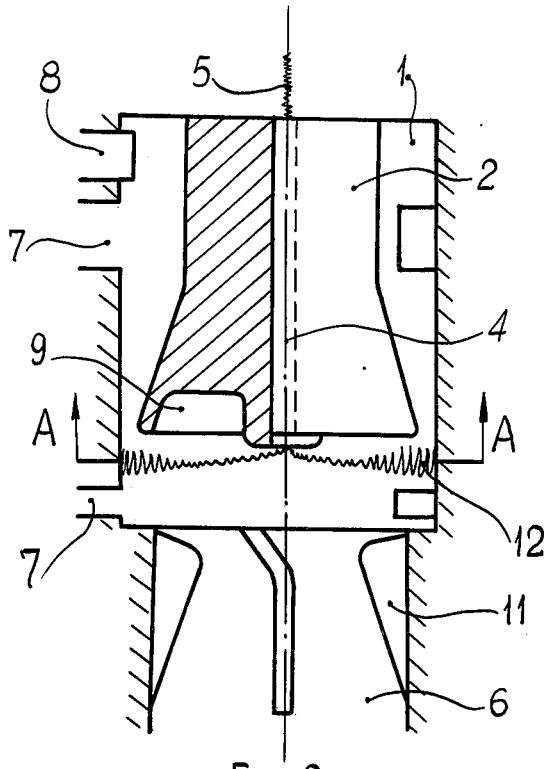
FIG. 3 is a longitudinal sectional view of an alternative embodiment of the invention.
Figure 4:
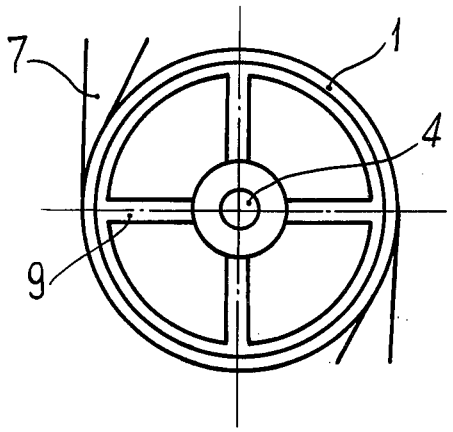
FIG. 4 is a view from the vacuum source side of FIG. 3 taken along line A—A.

FIGS. 3 and 4 illustrate an alternate embodiment. The cylindrical insert 2 is widened at the side of the yarn discharge, and blades 9 being accommodated in an insert face recess. At the vacuum source side, in the chamber 1 outlet, the guides are arranged to provide partial recovery of the air jet kinetic energy.

During operation air supplied through the suction duct 6, whereby the ducts 7 cause whirling of air inside the chamber 1. With the restricting blades 9, air particles swirling within the whirl core becomes partially rammed to cause the core internal pressure increase and to change the air flow direction, thus reducing the rotational velocity in the whirl core.

The fibres, as delivered through the inlet channel 8 as result of an air draft, will form a ring 12 swirling over the chamber 1 inner wall. A length of yarn is introduced into the chamber to start spinning, through the concentric channel 4. When rotating, this length free end associates with swirling fibres and gathers and twists them. Thereafter, the ready yarn is discharged out of the chamber.

While a preferred embodiment of the invention has been illustrated, many modifications may be made without departing from the spirit of the invention and it is intended not to be limited to the precise details of construction set forth but rather to all changes within the scope of the appended claims.

We claim:

1. A method of manufacturing of yarn inside a cylindrical, non-rotational chamber, employing air jets for whirling fibres introduced into the chamber, including the steps of: forming an intensification zone within said chamber by vacuum suction of a whirl core of said whirling fibres; and inhibiting the rotational velocity of the air flow into the chamber interior to reduce the velocity in the whirl core.

2. An apparatus for manufacturing yarn, employing a cylindrical, non-rotational spinning chamber provided at one end with a source of vacuum, and being closed at the other end by a cylindrical insert incorporating a yarn discharge channel; peripheral duct means disposed in said chamber to supply air; and fibre delivery means disposed within an upper portion of said chamber, wherein: said cylindrical insert lower face being provided with re-stricting blades, and said chamber having outlet means at the vacuum source side provided with air guides.

* * * * *